United States Patent [19]

Quinnen

[11] Patent Number: 4,613,336

[45] Date of Patent: Sep. 23, 1986

[54] KNITTED FABRIC PRODUCED FROM INDIGO-DYED YARN

[76] Inventor: Michael Quinnen, 124 Alexandra Road, Wimbledon, London, England, SW19 7JY

[21] Appl. No.: 657,240

[22] Filed: Oct. 3, 1984

Related U.S. Application Data

[63] Continuation-in-part of Ser. No. 507,453, Jun. 24, 1983, abandoned.

[30] Foreign Application Priority Data

Jun. 3, 1983 [GB] United Kingdom ..... 8315210
Jan. 19, 1984 [GB] United Kingdom ..... 8401370

[51] Int. Cl.[4] ..... D06P 5/00; C09B 7/00

[52] U.S. Cl. ..... 8/494; 8/504; 8/653; 8/918; 66/169 R; 66/170; 66/171; 66/189; 548/457

[58] Field of Search ..... 8/494, 504, 653; 66/169 R

[56] References Cited

U.S. PATENT DOCUMENTS 2,920,932 1/1960 Barnhill ..... 8/653
3,457,022 7/1969 Fields ..... 8/653
3,828,585 8/1974 Thorneburg ..... 66/136
3,952,555 4/1976 Lesley ..... 66/195
4,166,717 9/1979 Fond et al. ..... 8/653
4,283,198 8/1981 Fletcher ..... 8/653

OTHER PUBLICATIONS

The Application of Vat Dyes (AATCC Monograph #2), American Association of Textile Chemists and Colorists, 1953, p. 72.

Teckinik Wlokicnniczy (1977) vol. 27 II, pp. 302–304.

E. R. Trotman, "Dyeing and Chemical Technology of Textile Fibres," Fifth Edition, (Griffin, 1975), pp. 509–510.

*Primary Examiner*—A. Lionel Clingman

*Attorney, Agent, or Firm*—Cushman, Darby & Cushman

[57] ABSTRACT

Indigo dyed cotton yarn suitable for producing indigo dyed cotton knitwear, and method of producing it, comprising passing a cotton rope consisting of a plurality of yarn threads through a plurality of baths of indigo dyed liquor, allowing the dye to oxidize by exposure to air between each bath, and winding each of the said yarn thread separately to provide an indigo dyed yarn in a form suitable for knitting. The threads are wound onto individual spools, which may be rotated on a common shaft, or by individual motors. The indigo-dyed knitted cotton fabric produced shows the fading by abrasion, rather than washing out, normally associated with denim.

5 Claims, 18 Drawing Figures

FIG. 3.
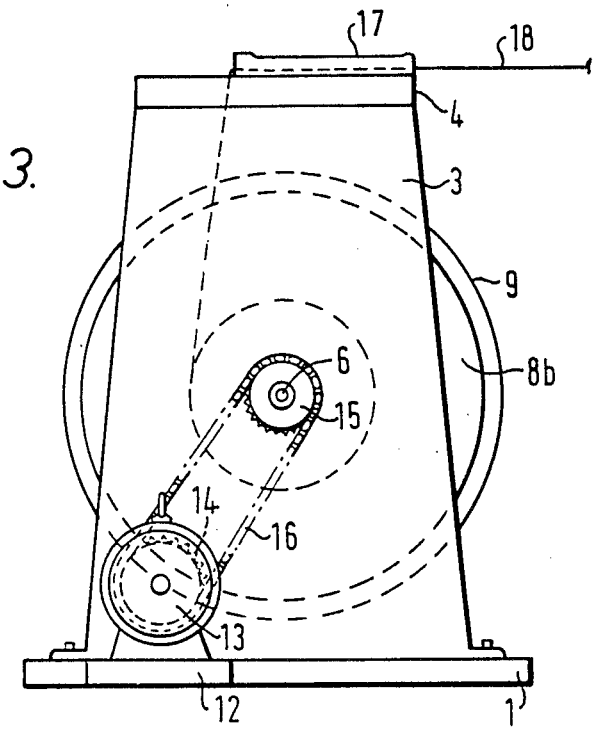
FIG. 4
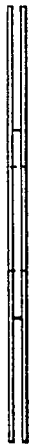
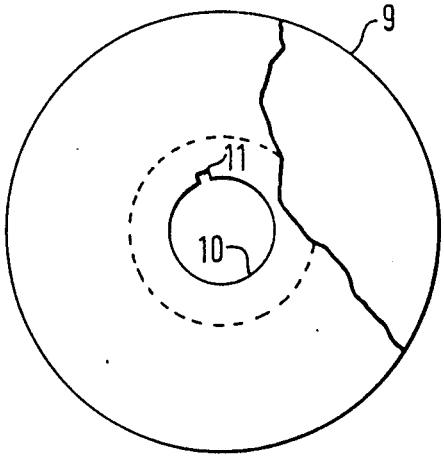
FIG. 4a

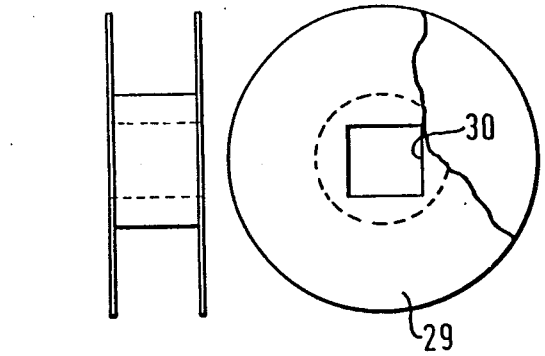
FIG. 7c
FIG. 7b
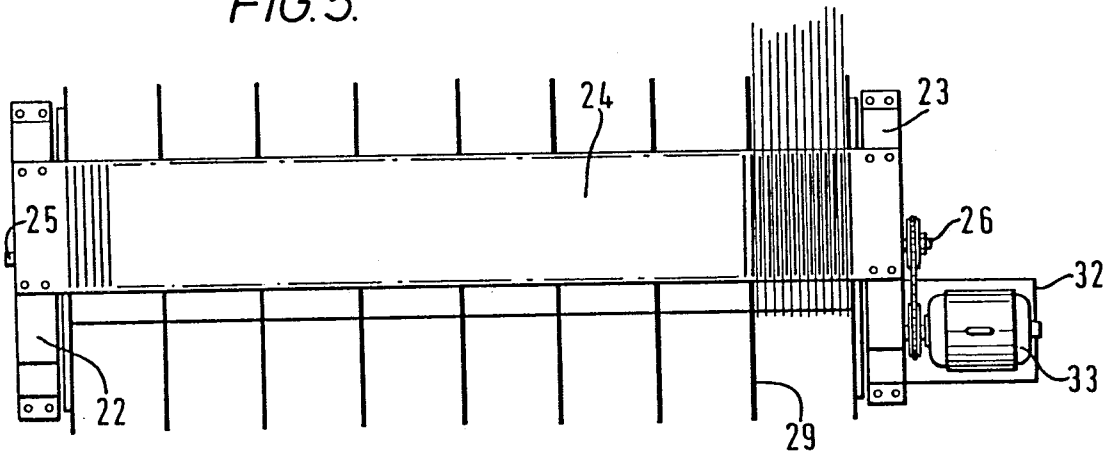
FIG. 5.

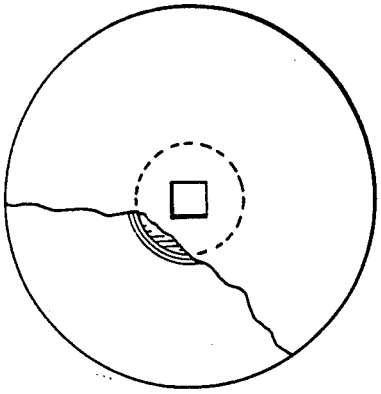
FIG.12d
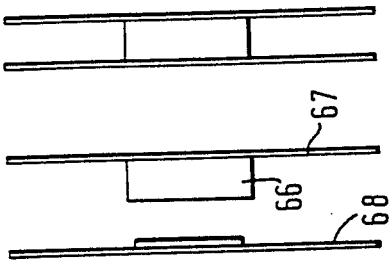
FIG.12a
FIG.12b
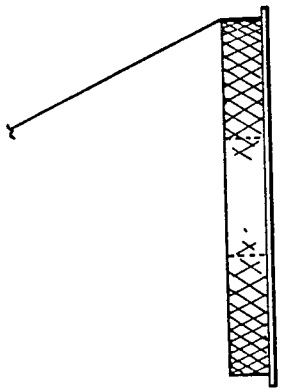
FIG.12c
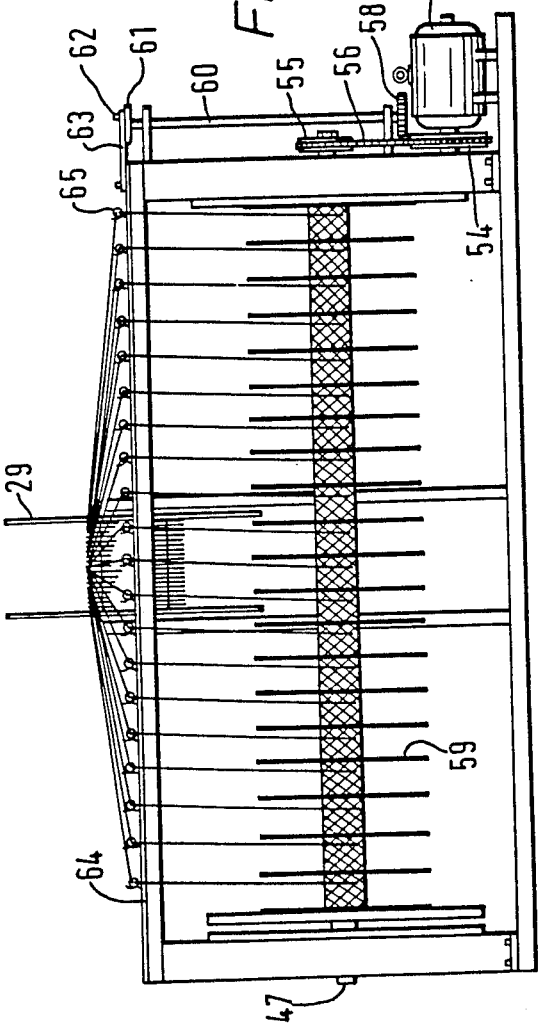
FIG.11.

KNITTED FABRIC PRODUCED FROM INDIGO-DYED YARN

This application is a continuation-in-part of U.S. Application Ser. No. 507,453 filed June 24, 1983, now abandoned.

This invention relates to the production of yarn, particularly indigo-dyed cotton yarn suitable for machine knitting and to knitted fabrics.

A common method of dyeing cotton yarn is known as "package dyeing", and comprises placing a loosely wound cone of the yarn into an apparatus similar to an autoclave, and utilising pressure to force the dye through the material to penetrate all the fibres.

This method is suitable for a great many dyestuffs, but not for indigo dye, which, in effect coats the yarn, rather than penetrating into it. Accordingly it is not possible to package-dye cotton yarn with indigo dye. Another method which is therefore commonly used, particularly for surface-coating dyes such as indigo, comprises passing a bulk quantity of the un-dyed yarn through a series of baths of the dye liquor, and oxidising the dye by exposure to air between each bath. The undyed spun yarn is commonly available in the form of a so-called "cross ball" which has the form of a rope consisting of a large number, for example 350, yarn threads (known in the art as "ends") each of, for example, 8000 meters in length, wound onto a reel. The "rope" is fed into the series of dye baths as a continuous strip, travelling for example on rollers, so that the rope becomes flattened to expose all the yarn surfaces to both the dye liquor and to the oxidising air. After the final bath, the rope is dried on heating means such as a hot roller. It is then usually folded, in concertina manner, and wound onto a reel-like structure known in the art as a "back-beam". A number of such back-beams are then wound side by side onto a warp beam, in the nature of a very large reel. Thus, the so-called "warp beam" may be likened to a very large cotton reel, perhaps six feet long, having a large number of yarn threads wound thereon in a generally parallel fashion.

Such a reel can then be loaded into a loom ready for weaving. For weaving purposes, this is an ideal form, because the yarn is required in the form of a large number of continuous parallel strands.

Indigo-dyed yarn produced and bulked in this manner is however unsuitable for knitting, which requires that the yarn should be on a cone-type package, and also made stable enough to knit with, i.e. should have the correct degree of twist and possibly waxing.

The present invention provides a fabric comprising knitted indigo dyed cotton yarn.

The present invention also provides a method of producing an indigo-dyed yarn, in a form suitable for knitting, which method comprises passing a rope consisting of a plurality of yarn threads through each of a plurality of baths of indigo dye liquor, oxidising the dye, e.g. by allowing the dye to oxidise by exposure to air between each bath, and winding each of the said yarn threads separately or separately winding small groups of the said yarn threads, e.g. pairs of threads, to provide an indigo dyed yarn in a form suitable for knitting.

The winding of individual threads may be carried out by engaging each of the yarn threads with a respective spool and rotating the spools at a common speed, and preferably in a common direction.

The spools may be driven by a common motor or as an alternative, each spool may be rotated by an individual motor.

Thus, in this first embodiment of a method according to the invention, the yarn threads may be wound directly from a "rope", to produce individual wound threads.

The invention also provides a method for producing an indigo-dyed yarn in a form suitable for knitting which process comprises passing a cotton rope consisting of a plurality of yarn threads through each of a plurality of baths of indigo dye liquor, oxidising the dye, e.g. by allowing the dye to oxidise by exposure to air between each bath, winding the said plurality of yarn threads onto a plurality of intermediate supports, thereafter winding the yarn threads from the said intermediate supports onto a plurality of individual supports, each of the said individual supports carrying a single thread which may be formed by one or more of the yarn threads of the cotton rope.

The intermediate supports may each be wound with a single yarn thread or "end".

However, in such simultaneous winding, a severe disadvantage is found that, if one of the individual yarn threads should break during the winding process, it is necessary to stop the entire machine whilst the two broken ends are re-tied. Because of the necessary size of the machine winding all of the "ends" of a rope simultaneously, it is often very difficult to gain access to the appropriate part of the machine to enable this tying operating to be carried out. Furthermore, simultaneous winding of a large number of ends makes it much more likely that a breakage will occur, because of the increased likelihood that one of the threads of the rope will have a different degree of tension from that of the remainder.

Accordingly in a preferred aspect the invention provides a method as described wherein a fraction not more than one half and not less than one twentieth of said plurality of threads is wound onto an intermediate support, preferably a plurality of such intermediate supports being simultaneously wound.

The threads on each intermediate support may then be wound onto individual supports, each of which may receive two or more of the yarn threads twisted together to form a single thread.

The individual supports may be cone-formers upon which the thread is wound as a cone or may be spools from which cones are wound in yet a further stage.

The methods of winding yarn described above may also be applied to yarn other than indigo dyed cotton. Accordingly, the present invention includes a method of producing yarn in an intermediate wound form, suitable for transfer to a cone packaging machine, which method comprises steps of:

(i) engaging each of the "ends" of a "rope" of yarn with a respective one of a plurality of spools, (ii) rotating all of the spools at a common speed and in a common direction to wind each of the "ends" onto the respective spool.

Preferably, the rate of rotation of the spools is varied, e.g. reduced progressively as winding proceeds and as the diameter of the winding increases, so that a constant rate of travel of the yarn onto the spool is achieved.

According to a more preferred aspect of the invention, there is provided a method of producing yarn in a wound form suitable for knitting, which method comprises, providing the yarn in the form of a rope comprising a plurality of yarn threads, simultaneously winding a proportion of the yarn threads of the rope onto an intermediate support, the said proportion being not more than one half and not less than one twentieth of the number of yarn threads of the rope, and thereafter winding the said yarn threads from the intermediate support onto a plurality of individual supports, each of the said individual supports carrying a single thread which single thread may comprise two or more yarn threads twisted together to form a single composite thread.

Preferably a plurality of such intermediate supports are simultaneously wound, each with a similar proportion of the threads of the rope.

The invention includes apparatus for producing a wound yarn, comprising means for supporting a winding comprising a plurality of yarn threads wound together on a support, a plurality of winding supports for receiving the yarn threads, and means for rotating the winding support to take up the yarn threads and for rotating the winding so as to unwind the yarn threads therefrom.

The winding may be a winding of a rope known in the art as a "beam" as described above. Alternatively, the winding may itself be an intermediate winding of a plurality of "ends" from a "beam".

The apparatus may preferably therefore comprise a support for a "beam".

When the said winding is a "beam", the "winding supports" may be intermediate winding supports each receiving a plurality of yarn threads.

Preferably from one quarter to a tenth of the threads of the rope are wound onto each intermediate support, and in a particularly preferred embodiment, eight intermediate supports are provided, each winding simultaneously one eighth of the rope threads. The intermediate supports may preferably carry about forty threads each.

Preferably the apparatus comprises a separator for the individual yarns being fed to the spools, and in a convenient form the separator has a plurality of fingers or plates which are spaced to receive each yarn between a respective pair of them. The totality of the fingers or plates may be arranged in line as a comb-like formation, and may be included on the support structure, for example parallel to the axis of the rotor.

Particularly in the case where a yarn thread, or more preferably two or more yarn threads, are wound as a single thread onto an individual support, means are preferably providing for applying a twisting during the winding process.

In a particularly preferred embodiment, the individual winding supports are each powered by an individual motor, and means may be associated with each individual winding support for sensing breakage in its associated thread, to cause stoppage of all of the said winding supports on such breakage.

Preferably the means for rotating the winding supports is so arranged as to vary the rate of rotation of the winding supports so that a constant rate of travel of the yarn onto the winding support is achieved as winding proceeds, and for example the rate of rotation may be reduced uniformly as the diameter of the winding increases.

In a preferred construction, the apparatus comprises a support structure, a common rotor journalled on the support structure and receiving all of the winding supports in axial alignment, means providing rotary connection between the rotor and the winding supports, and drive means for rotating the rotor. The means for providing rotary connection may be keying acting between the rotor and each of the winding supports and for example the rotor may be an axle or shaft which may have a non-circular e.g. a radially directed keying formation to engage with a corresponding counter-formation of each winding support.

The means for rotating the winding supports may be a prime mover, e.g. an electric motor, coupled through a suitable drive train, such as sprockets and a chain, to the rotor. Preferably means are provided to sense the increasing diameter of the winding, whether by size of the winding or by alteration of tension in the yarn, or both, to vary the speed of drive and maintain a constant rate of transfer of the yarn onto the spools. Alternatively, one or more yarns may engage with a speed regulating means, prior to reaching the respective spool, arranged to sense changes of linear speed and provide feedback to ensure that the rate of passage of the yarn remains at least nearly constant.

In a further step, the yarn may be unwound from the individual support onto individual cone formers, e.g. in a winding machine of known kind utilising so-called ring tubes. It may thereafter be wound into larger cones, known as cheeses, and then spun into a form suitable for knitting. Spinning may be arranged to transform the single yarn into a 2-ply or 3-ply yarn especially suitable for knitting. Some twist is preferably applied during spinning, and a twist within the range 5–5½ turns per inch is preferred, for stabilizing of indigo-dyed yarn.

Such yarn may then be knitted. By way of example, the thread may be knitted (alone) in known manner on flat bed, circular or fully-fashioned machines, or may alternatively be knitted, for example on a circular double bed machine, with a finer yarn to create a "sweatshirt" type of fabric. With this method, twist of the yarn may not be essential. The combined materials may comprise a 2-ply yarn and a 3-ply yarn, and in this method it is the finer yarn which is being knitted, whilst the indigo-dyed yarn then forms a looped-surface effect similar to that of towelling. The combined yarns may then be "hot gassed", which entails passing the yarns through a flame rapidly to burn off any hairs, resulting in a material which is smoother and less inclined to pilling, i.e. going fluffy with wear.

A particular advantage of indigo-dyed yarn, obtained in small cone package form by the invention, is its ability to be used for the production of indigo dyed cotton knitwear. Woollen knitwear shrinks if washed in a washing machine. Acrylic fibre material tends to distort and become "lifeless", and may achieve unpleasant tactile characteristics. On the other hand, mercerised cotton knitwear, although subject to shrinkage when washed, becomes stabilized after one wash. It is accordingly known to provide cotton knitwear, at a marketable cost, that can be washed once before sale so as not to be subject to further shrinkage when washed subsequently by the purchaser. A similar advantage can be held out for woven goods, an example of which would be articles of clothing, e.g. jeans, made of denim material.

Cotton denim is known to be strong and comfortable, and its appearance improves with washing and wearing.

The method and apparatus of the invention permit the manufacture of a new fabric material, that is to say indigo-dyed knitted cotton.

The invention includes a fabric produced by knitting a yarn produced in a form suitable for knitting by a method as described above.

Knitted indigo-dyed cotton fabrics according to the invention can be pre-washed and thus pre-shrunk so as to be machine-washable. With such material, there is a further advantage for certain types of article that indigo-dyed denim fades by abrasion, rather than by washing out, thus enabling the faded material to have highlights and a more textured appearance.

In order that the nature of the invention may be readily ascertained, an embodiment of apparatus in accordance therewith and utilisable in the method set forth above is hereinafter particularly described with reference to the accompanying drawing, wherein:

FIG. 3 is an end elevation of the machine of FIG. 1, viewed in the direction fo the arrow "A" in FIG. 2;

FIG. 4 shows an edge elevation and FIG. 4*a* a side elevation of a spool for use with the machine of FIG. 1.

FIG. 5 is a plan view of a machine for winding a rope onto eight intermediate supports;

Figure 7A:
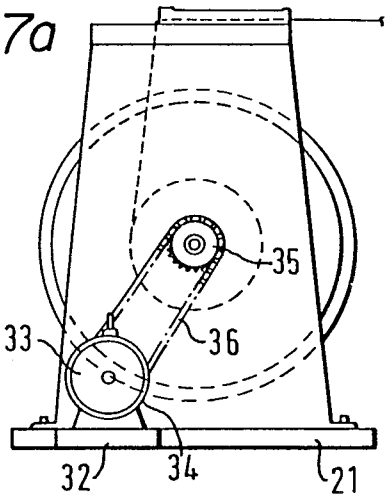

FIG. 7*a* is an end elevation of the machine of FIG. 5;

FIG. 7*b* and FIG. 7*c* shows two views of an intermediate winding support spool of the machine of FIGS. 5 to 7*a*.

Figure 8:
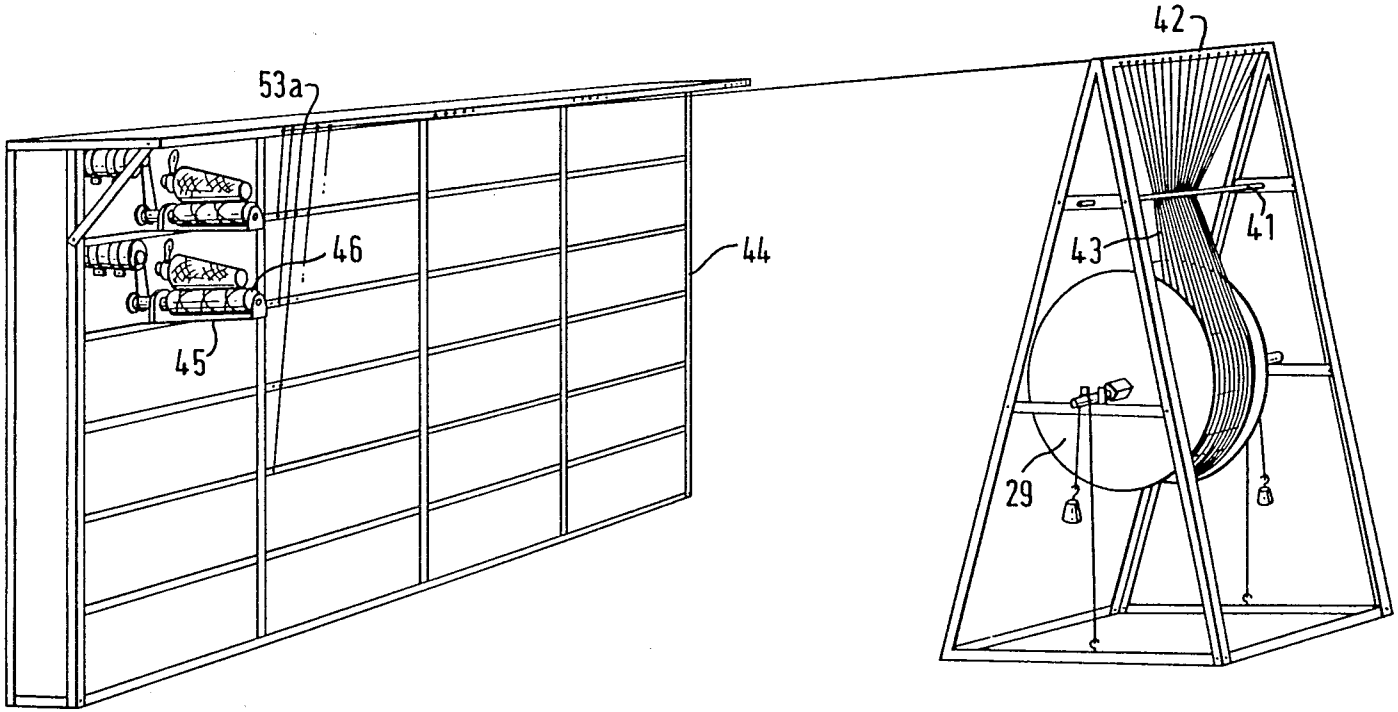
Figure 9:
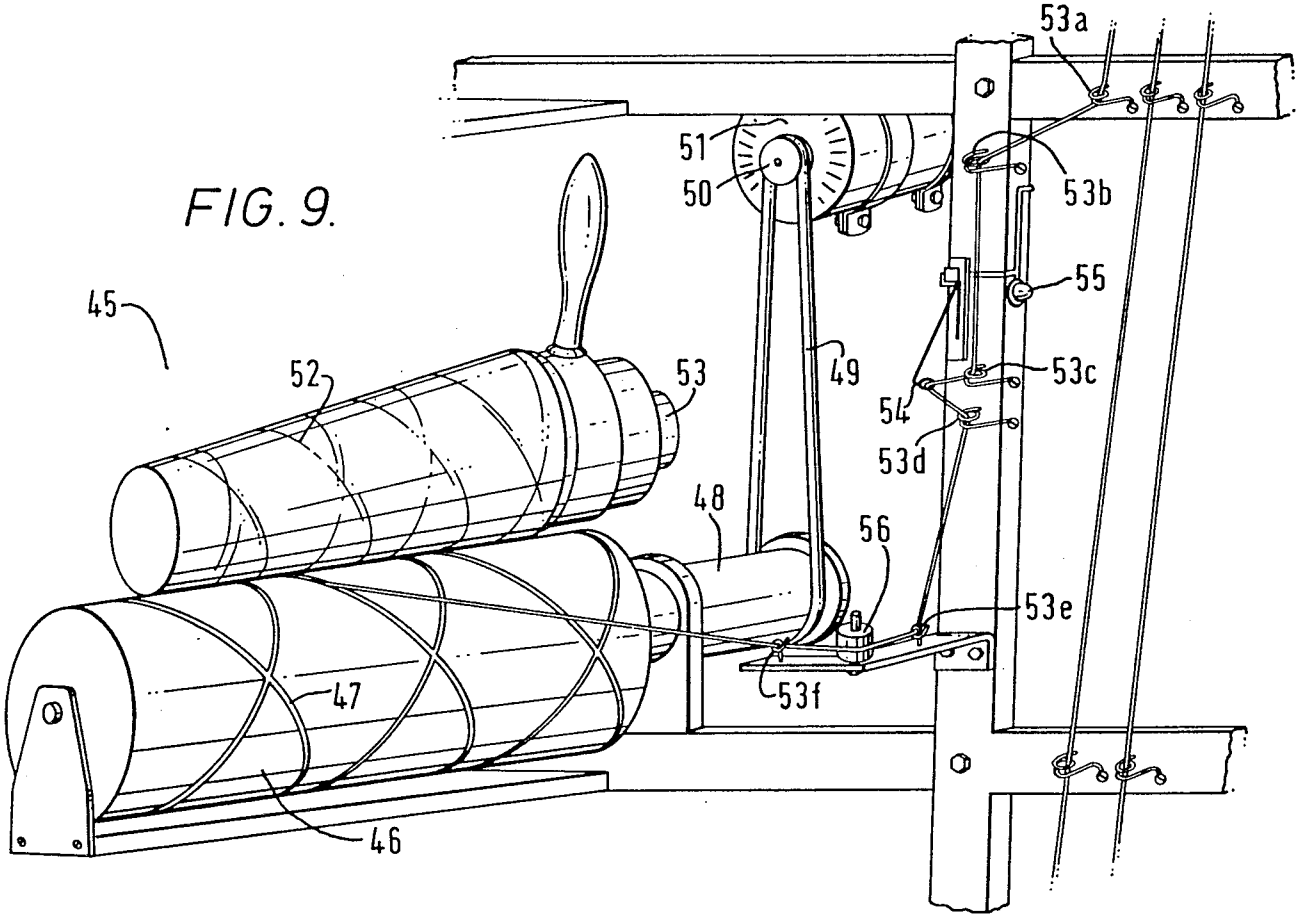
Figure 10:
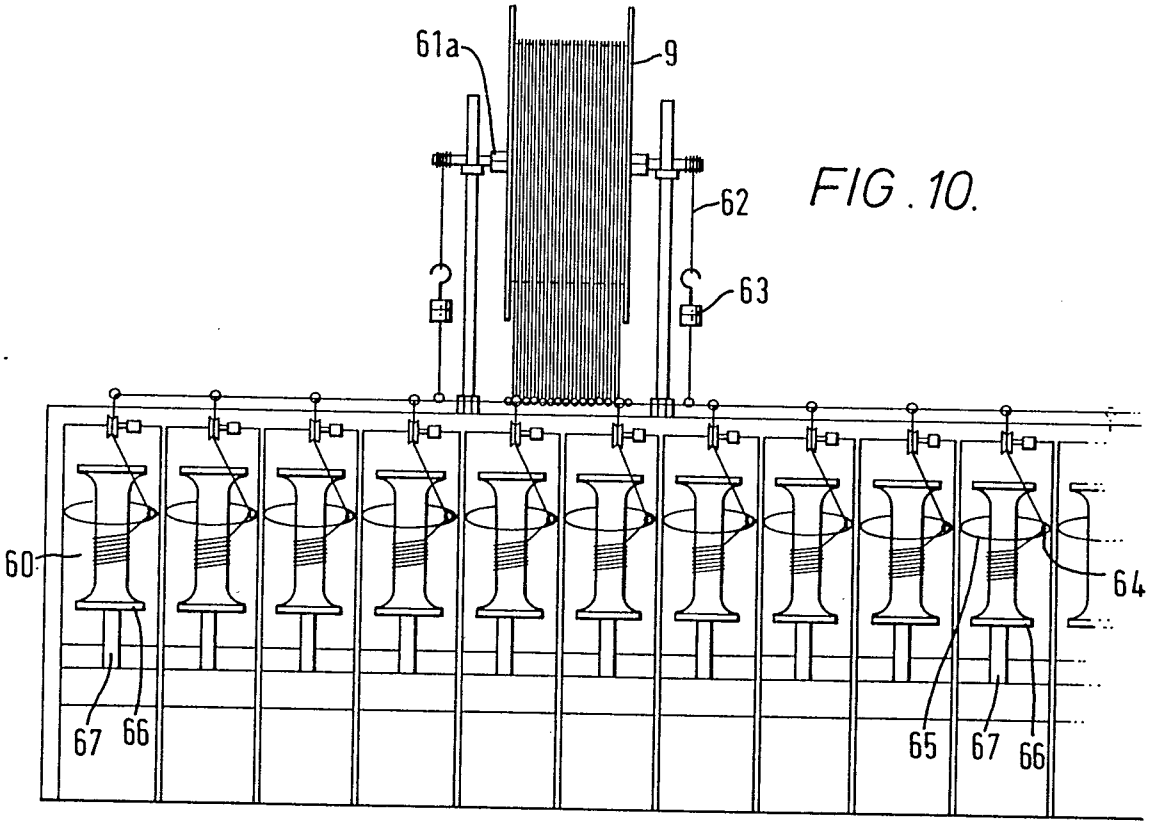

FIG. 8 is a schematic diagram of a winding frame for winding individual yarn threads;

FIG. 9 shows an individual winding head as used in the apparatus of FIG. 8; and FIG. 10 shows a doubling frame.

FIG. 11 is a front-elevation of a machine for winding threads from an intermediate support onto individual spools.

FIGS. 12(*a*) to (*d*) show an individual spool of the machine of FIG. 11.

The machine according to FIGS. 1 to 4 comprises a support structure having a base 1 on which are bolted upright end members 2 and 3 supporting an upper cross-member 4. Each of the end members 2,3 has a bearing for a respective journal portion 5 or 6 of an axle 7, and the axle can rotate freely in the bearings. The axle has a longitudinal slot to receive a radially-projecting key 8. A plurality, e.g. between 270 and 370, of similar spools 9 (see FIG. 4) are mounted with clearance by their central aperture 10 on the axle 7, and each spool has a radial recess 11 to receive, with clearance, the elongate key 8 of the axle, thereby to provide rotational drive for all of the spools. The axle has fixed end plates 8*a*, 8*b* between which the spools are assembled.

At one end the base 1 is extended to provide a platform 12 on which is mounted an electric motor 13 having a drive shaft carrying a drive sprocket 14. A sprocket 15 is keyed on the adjacent end of the axle 7 and a chain 16 is engaged about the two sprockets. Control means (not shown) are provided in the current feed circuit of the motor 13 to regulate its speed in the manner described.

On the upper cross-member 4, at its upper face, there are provided a plurality of parallel upright plates 17 which collectively form a comb, and each yarn 18 to be wound onto a respective spool 9 is passed between an adjacent pair of the plates 17.

In use, the dyed dried "rope" of, say, 350 "ends" of cotton yarn, coming from the dyeing and drying apparatus, is separated out into the individual "ends" and each "end" is threaded between a respective pair of plates 17 and then engaged in any convenient manner with the hub portion of the respective spool 9. The motor 13 then drives the assembly of spools in rotation, to wind each yarn onto an individual spool.

The full spools on the axle are removed as a complete unit, and replaced with an axle of empty spools. The filled spools are removed from the axle, and the contents individually wound onto cones.

Figure 6:
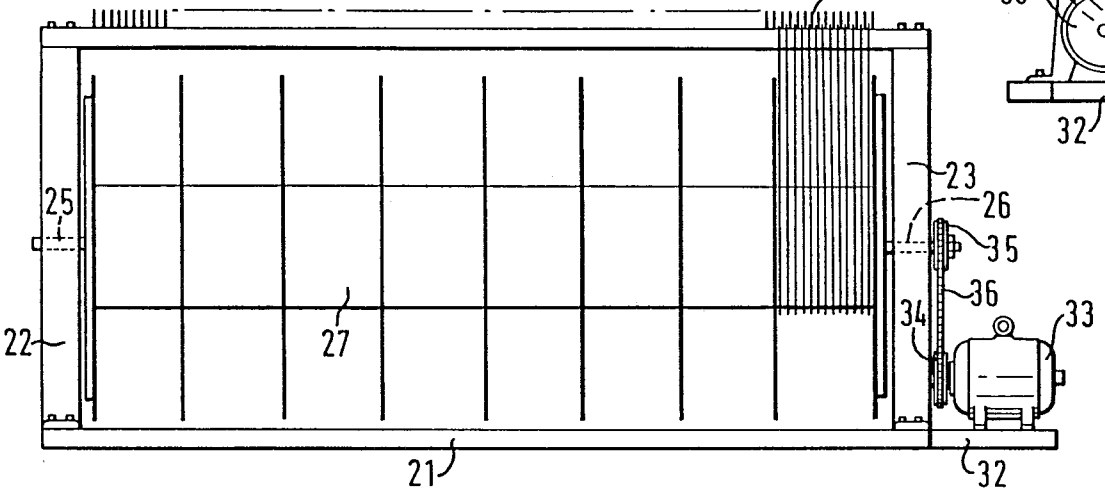
FIG. 6 is a front view of the machine of FIG. 5.

The apparatus of FIGS. 5 to 7 is generally similar to that of FIGS. 1 to 4, the only difference of substance being that the spools 29 onto which the yarn threads are wound are of substantially increased width, and can accommodate in parallel fashion approximately forty yarn threads. The parts which the machine has in common with the machine of FIGS. 1 to 4 will therefore not be described in detail. Corresponding parts of FIGS. 5 to 7 to parts 1 to 9 and 12 to 17 of the apparatus of FIGS. 1 to 4 are referenced as 21 to 29 and 32 to 37 respectively, in FIGS. 5 to 7. Instead of the keyed central aperture 10 of the spool of FIG. 4, each spool 29 simply has a square central aperture 30, which accommodates a square shaft or axle 27 Each spool 29 may typically have a diameter of 700 mm and a hub diameter of 120 mm with an interflange spacing of 180 mm.

The apparatus of FIGS. 5 to 7 may also preferably incorporate a support for a so-called "back beam", which consists of a construction akin to a single large reel, having 320 yarn threads wound thereon in parallel fashion.

The apparatus of FIGS. 5 to 7 will therefore generally be utilised to divide such a back beam into eight individual intermediate supports (i.e. the spools 29) each containing forty yarn threads or "ends".

As an alternative, only twenty "ends" may be wound onto each spool, such that only 160 "ends" of the beam are taken off initially. The remaining 160 ends are secured to prevent them from becoming tangled. After the first 160 ends have been wound onto the spools 29, the remaining 160 ends on the beam are each tied to a respective one of the threads wound on the spools 29. The winding process then continues to produce eight spools 29, each having twenty yarn threads wound thereon, having a length of twice that of the original rope.

FIG. 8 is a simple schematic diagram showing a part of an array of, e.g. forty winding heads, each for winding a single thread from one of the spools of FIGS. 5 to 7. As shown in FIG. 8, each of the spools of FIG. 5 may be mounted on a simple support, for example an "A" frame, provided with a braking mechanism in the embodiment shown a simple cord and weight.

From the spool 29, the yarn threads 43 are separated and pass over tensioning bars 41 and 42, and thence to the winding frame, indicated generally at 44.

The winding frame includes a plurality of winding heads 45, of which only two are shown, for clarity. Each column of winding heads includes a number of thread guides 53*a*, corresponding to the number of winding heads in the column. The frame 44 may be of any desired size, to accommodate the number of yarn threads on the spool 29.

The structure of the individual winding heads 45 is shown in more detail in FIG. 9.

As can be seen in FIG. 9, each winding head 45 comprises a cylindrical stainless steel drive roller 46 mounted for rotation about a horizontal axis. Drive roller 46 has a helical groove 47 in its surface which runs from one end of the roller to the other, reverses its pitch and returns to its starting point.

Coaxial with and extending from one end of roller 46 is a large diameter spindle 48 around which runs a drive belt 49. Belt 49 also passes around a drive pulley 50 mounted on the drive shaft of an electric motor 51. The arrangement is such that drive belt 49 will slip if there is resistance above a certain level to rotation of the drive roller.

Immediately above roller 46, a cone former 52 is mounted for rotation with its surface in contact with that of roller 46. An axle 53 on the axis of rotation of the cone is mounted by means not shown for movement toward and away from roller 46 and is biased, e.g. by its own weight, to move towards the roller.

The thread is caused to pass through thread guides 53*a* to 53*f*, and over a finger 54, connected to an electrical switch (not shown) arranged to stop the mechanism should the thread break. A warning light 55 is also provided to draw attention to the winding head which has caused the stoppage in this event. The thread passes into groove 47 and is engaged on the cone former 52.

Wax is applied to the thread during the winding process by causing it to pass over a waxed disc 56.

In operation each drive roller 46 is rotated by a respective electric motor 51. Frictional engagement between the roller 46 and the cone former 52 causes rotation of the cone former 52 to wind on a yarn thread. Traverse of the thread up and down the length of the cone former is produced by the groove 47.

The resistance to rotation sufficient to cause slipping of the belt 49 is arranged to be less than the breaking strain of the thread.

FIG. 10 is a schematic elevation of a doubling frame comprising a plurality of vertically moved winding heads 60, e.g. twenty arranged in two parallel banks of ten, each adapted to wind two threads from a spool 29 as shown in FIG. 5 as a single thread onto a single individual support 66, and to apply twist thereto.

The doubling frame comprises a support including an axle 61 upon which spool 29 is rotatable to unwind threads therefrom. A braking mechanism is provided by cords and weights 62,63 running over extensions of axle 61.

Pairs of threads are passed together through a respective traveller 64 running in a track in a ring 65. Each ring 65 is in use lifted up and down by movement of a lifting rail not shown. Within each ring, a spool 66 is mounted for rotation about a vertical axle 67. Each spool 66 is driven by engagement of its axle 67 by a drive belt.

Rotation of spools 66 draws thread from spool 29 and tension in the thread sets up rotation about each ring of the respective traveller, imparting twist to the doubled yarn. Traverse of the threads on the spool 66 is caused by rising and falling of each ring 65 in response to the ring lifting rail.

FIG. 11 shows in elevation a winding mechanism for winding individual ends onto spools from a spool 29 having twenty ends wound thereon, e.g. a spool 29 as produced using the winding machine of FIG. 5.

As shown in FIG. 11 the winding machine comprises a support frame mounting a spool 29 for rotation about a horizontal axis.

Below spool 29 is a square section shaft 47 journalled in upright end members 42,43. Upon shaft 47 are twenty spools 59 which each have a square central aperture which is engaged with the shaft 47.

Figure 1:
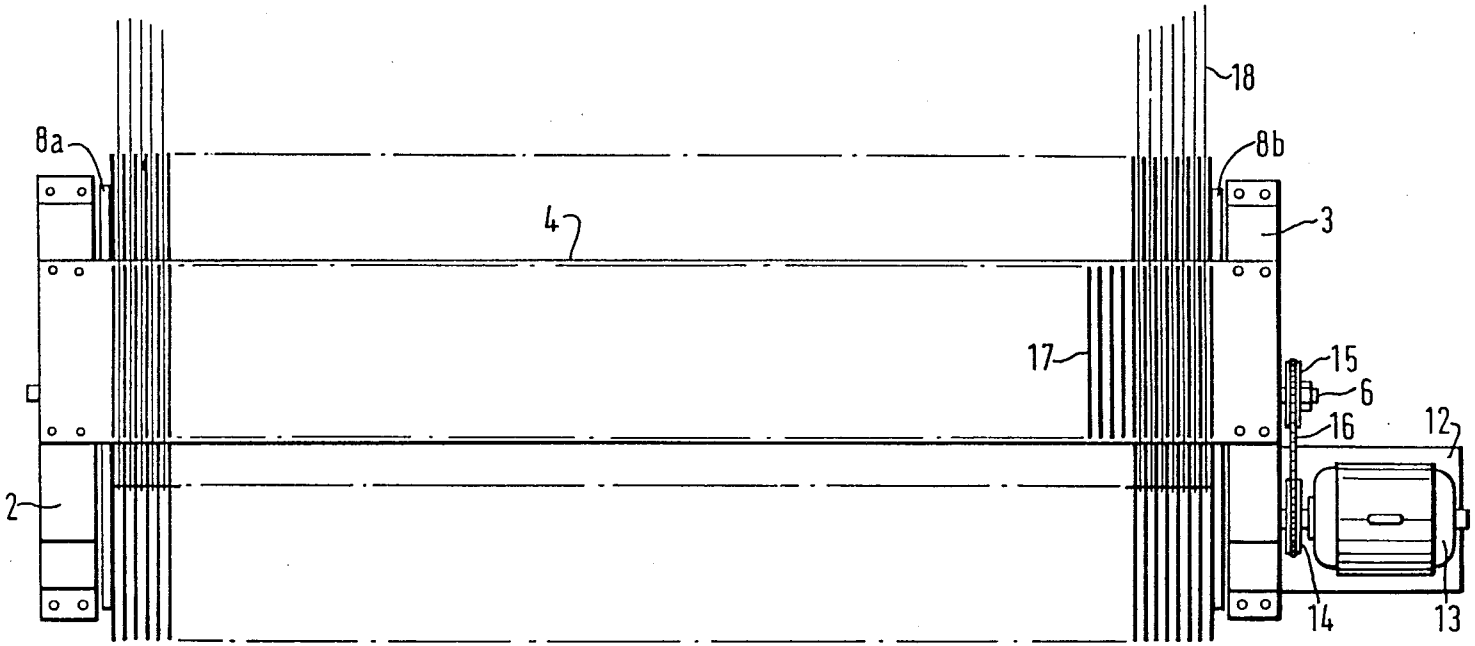
FIG. 1 is a plan view of a multiple spool winding machine.
Figure 2:
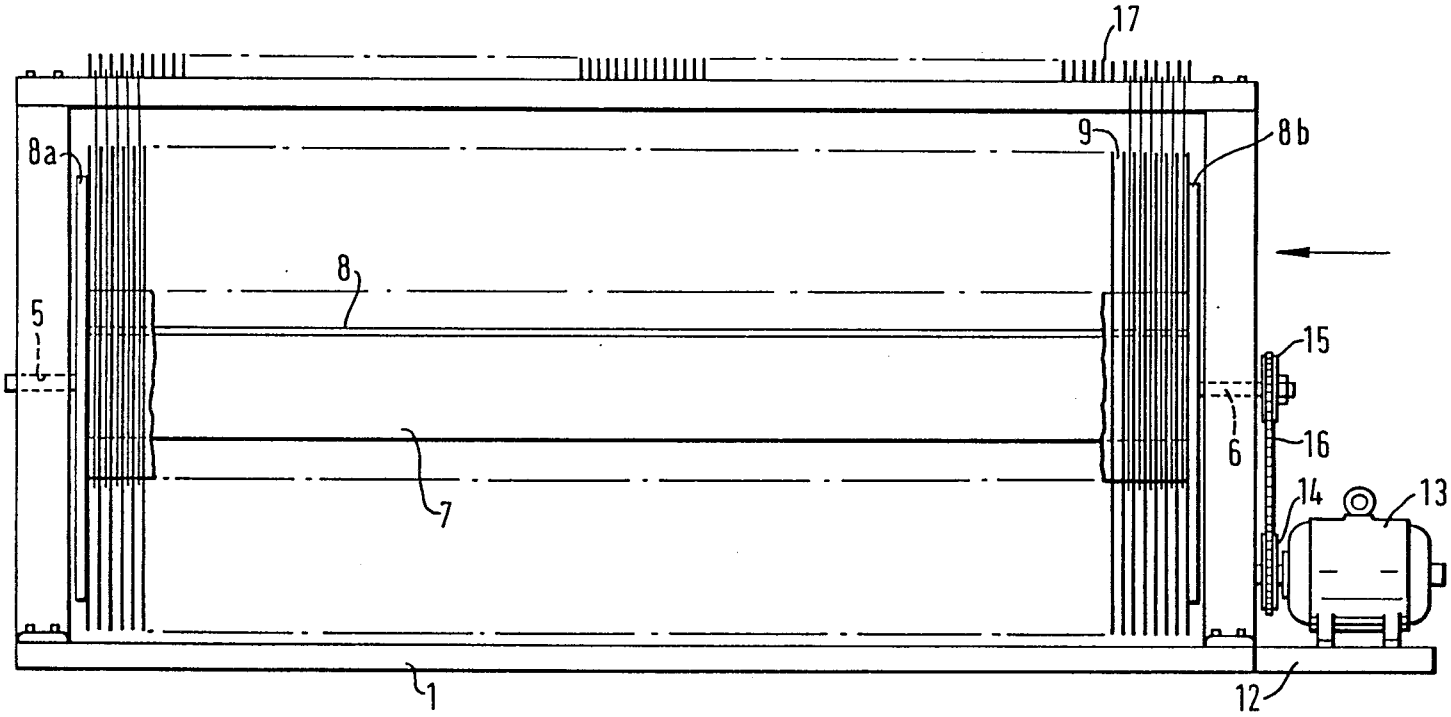
FIG. 2 is a front elevation of the machine of FIG. 1.

As in FIGS. 1 and 5 a motor 53 drives the shaft 47 via a chain 56 and sprockets 55 and 54. Additionally a bevel gear 58 is driven off the drive shaft of motor 53 to drive a vertical shaft 60. Mounted on the top of shaft 60 is a disc 61 having a pin 62 fixed therein parallel to the shaft 60. Mounted on pin 62 is one end of a connecting rod 63.

A traverse rod 64 extends parallel to shaft 47 and is articulated to connecting rod 63. Twenty thread guides 65 are mounted on traverse rod 64.

Spool 29 has twenty ends of yarn wound thereon. Each end of yarn is passed through a thread guide 65 and engaged on a spool 59.

Motor 53 drives 57 to rotate the spools 59 and wind up yarn thread onto each. Simultaneously, rotation of shaft 60 produces reciprocation of traverse rod 64 and hence traverse winding of each yarn thread on its respective spool.

As shown in FIG. 12, each spool comprises a hub 66 and a pair of flanges 67,68 and is splittable (See FIG. 12(*b*)) by removal of flange 68 leaving the winding of thread on the hub, as shown in FIG. 12(*c*).

Typical dimensions for a spool of FIG. 12 would be a diameter of 400 mm, a hub diameter of 120 mm and an interflange spacing of 65 mm.

Cones of thread may readily be wound from the split spool 59. There is less tendency for the thread to break in cone winding from a split spool. If the spool is not split it must be rotated to unwind the thread, whereas in the apparatus of FIG. 8 this can be done by pulling threads off the spool 29 without rotation. In the case where there is only one end, the force required to turn the spool would be likely to cause the thread to break.

The invention is not limited to the specific features described in connection with the illustrated embodiments but includes many equivalents, variations and modifications thereof.

I claim:

1. A fabric produced by the steps of:
(a) subjecting a rope consisting of a plurality of individual cotton yarn threads to a plurality of exposures to an indigo dye liquor,
(b) oxidizing the dye between the said exposures,
(c) separating the individual yarn threads of the rope, and winding the separated yarn threads onto a plurality of supports, each carrying no more than a small group of the said individual yarn threads, and
(d) utilizing the said wound and separated yarn threads to produce a knitted indigo-dyed fabric.

2. A method of producing an indigo-dyed knitted fabric, which method comprises passing a rope consisting of a plurality of cotton yarn threads through each of a plurality of baths of indigo dye liquor, oxidizing the dye between each bath, and winding said yarn threads onto a plurality of supports such that each of said supports carries no more than a small group of the said yarn threads, thereby to produce separate indigo-dyed yarns, and thereafter utilizing said yarns in a knitting process to produce an indigo-dyed knitted fabric.

3. A method as claimed in claim 2, wherein said step of winding said yarn threads includes engaging each of the said yarn threads of the said rope with a respective spool, and rotating the spools at a common speed to wind each of the yarn threads onto the respective spool.

4. A method according to claim 2, wherein the said plurality of yarn threads is first wound onto a first plurality of supports, each support of the said first plurality of supports carrying not more than half and not more than one-twentieth of said yarn threads, and thereafter the said yarn threads from the said first plurality of supports is wound onto a second plurality of supports, each support of said second plurality of supports carrying a single thread which may be formed by one or more of the yarn threads of the cotton rope.

5. A method of producing a knitted fabric, wherein the knitting is carried out using an indigo-dyed cotton yarn produced by (a) subjecting a rope consisting of a plurality of individual yarn threads to a plurality of exposures to indigo dye liquor;

(b) oxidizing the dye between the said exposures; and (c) separating the individual yarn threads of the rope, and winding the separated yarn threads onto a plurality of supports, each support carrying no more than a small group of the said individual yarn threads.

* * * * *